US009175424B2

(12) United States Patent
Hwang et al.

(10) Patent No.: US 9,175,424 B2
(45) Date of Patent: Nov. 3, 2015

(54) METHOD OF PREPARING CARBON FIBER FROM WOOD WASTE INCLUDING ADHESIVE

(71) Applicant: KOREA INSTITUTE OF SCIENCE AND TECHNOLOGY, Seoul (KR)

(72) Inventors: Jun Yeon Hwang, Jeollabuk-do (KR); In Su Seo, Daejeon (KR); Kil Young Park, Jeollabuk-do (KR); Bon Cheol Ku, Daejeon (KR); Seong Mu Jo, Seoul (KR); Hun Su Lee, Seoul (KR)

(73) Assignee: KOREA INSTITUTE OF SCIENCE AND TECHNOLOGY, Seoul (KR)

( * ) Notice: Subject to any disclaimer, the term of this patent is extended or adjusted under 35 U.S.C. 154(b) by 26 days.

(21) Appl. No.: 14/250,883

(22) Filed: Apr. 11, 2014

(65) Prior Publication Data

US 2015/0078983 A1 Mar. 19, 2015

(30) Foreign Application Priority Data

Sep. 17, 2013 (KR) ..... 10-2013-0112063

(51) Int. Cl.
*D01F 9/16* (2006.01)

(52) U.S. Cl.
CPC ..... *D01F 9/16* (2013.01)

(58) Field of Classification Search
CPC ..... D01F 9/16
USPC ..... 423/447.4–447.9
See application file for complete search history.

(56) References Cited

U.S. PATENT DOCUMENTS

2010/0285223 A1 11/2010 Park et al.

FOREIGN PATENT DOCUMENTS

| | | | |
|---|---|---|---|
| JP | 2007-283234 | A | 11/2007 |
| JP | 2012-117162 | A | 6/2012 |
| KR | 1019950700460 | A | 1/1995 |
| KR | 1020040026191 | A | 3/2004 |
| KR | 1020100121386 | A | 11/2010 |
| WO | 01/86043 | A1 | 11/2001 |

OTHER PUBLICATIONS

Ma Xiaojun et al; "Preparation of carbon fibers from liquefied wood", Wood Science Technology, vol. 44, Issue 1, pp. 3-11; Feb. 2010.
Ahu Gumrah Dumanli, et al; "Carbon fibres from cellulosic precursors: a review", Journal of Materials Science, vol. 47, Issue 10, pp. 4236-4250, May 2012.
Shunjin Peng, et al; "Lyocell Fibers as the Precursor of Carbon Fibers", Journal of Applied Polymer Science, vol. 90, pp. 1941-1947; Article first published online: Sep. 17, 2003.
Korea Patent Office Notice of Allowance dated Sep. 24, 2014; KR10-2013-0112063.

*Primary Examiner* — Daniel C McCracken
(74) *Attorney, Agent, or Firm* — Ladas & Parry LLP

(57) ABSTRACT

Provided is a method of preparing cellulose fiber and carbon fiber by recycling industrial wood waste, wherein the carbon fiber is prepared by preparing high purity cellulose pulp by using, as a raw material, wood waste generated by manufacturers of pulp, furniture and other industrial products from wood and by eliminating resin and lignin impregnated in the wood waste through pulping and bleaching of the raw material, by preparing cellulose fiber by directly dissolving the prepared pulp in a cellulose solvent, and then by performing stabilizing and carbonizing with the cellulose fiber as a precursor.

12 Claims, 3 Drawing Sheets

METHOD OF PREPARING CARBON FIBER FROM WOOD WASTE INCLUDING ADHESIVE

RELATED APPLICATIONS

This application claims the benefit of Korean Patent Application No. 10-2013-0112063, filed on Sep. 17, 2013, in the Korean Intellectual Property Office, the disclosure of which is incorporated herein in its entirety by reference.

BACKGROUND

1. Field

One or more embodiments of the present invention relate to a method of preparing carbon fiber from wood waste including an adhesive. More specifically, one or more embodiments of the present invention relate to a method of economically preparing high purity cellulose fiber from wood waste including an adhesive including urea resin and/or urea melamine resin, and a method or preparing high performance carbon fiber using the high purity cellulose fiber as a precursor fiber.

2. Description of the Related Art

Carbon fiber refers to a fiber, which is obtained by carbonizing of an organic fiber precursor, having 90% or higher carbon content. Carbon fiber may be classified as polyacrylonitrile(PAN)-based carbon fiber, pitch-based carbon fiber, and rayon-based carbon fiber, according to the type of the precursor. Due to the high performance properties such as high strength, light weight, and electric conductivity, carbon fiber is extensively used in manufacturing automobiles, ships, aircrafts, and spacecrafts.

The first carbon fiber was prepared by using cellulose fiber such as viscose rayon as a precursor material, but the physical properties and the carbonization yield were low. Hence, currently, most carbon fibers are produced by using an acrylic fiber which is prepared by using a PAN-based copolymer as a precursor. The PAN-based carbon fiber has excellent physical properties, but the price is high. To make carbon fiber be utilized generally in industries, carbon fiber of low price needs to be developed and provided. For this, carbon fiber may be prepared by using raw materials of low price or by recycling waste. From this point of view, a method of preparing carbon fiber by using wood as a raw material has been suggested.

In a representative method of preparing carbon fiber using natural wood, an attempt has been made to prepare carbon fiber by using lignin, which is generated in wood pulp process, as a precursor. However, as lignin itself is hard to be fiberized, carbon fiber was prepared by firstly preparing lignin composite fiber by mixing lignin with another synthetic polymer and fiberizing the mixture, and then carbonizing the lignin composite fiber. However, the carbon fiber prepared by the method is not commercially produced as the physical properties of the carbon fiber are very bad. On the other hand, as a method of preparing carbon fiber by using wood which has not undergone a purification procedure, a method of preparing cellulose fiber and carbon fiber wherein a spinning dope is prepared by dissolving wood power of a size of 80 mesh or less in phenol solvent and melt spinning is performed with the spinning dope was suggested (Ma, Xiaojun. et. al. Wood Sci. Technology, 44, 3-11, 2010). However, the method has not been commercialized as the organic solvent used in the method, such as phenol, is harmful to human body and the environment, and thus the use is restricted.

Preparing cellulose fiber by using wood waste and preparing carbon fiber by using the cellulose fiber as a precursor may provide a great economic advantage in the aspects of resources recycling and economic feasibility. Wood waste is very cheap, as it is discarded by burying or incinerating, and thus wood waste has very high potential to be used as a raw material for preparing cellulose fiber and carbon fiber at a low price. However, as wood waste includes not only hemi-cellulose included in wood as well as a great quantity of an adhesive such as urea resin and urea-melanin resin which has been used in wood processing, it is difficult to obtain high purity cellulose pulp, which enables to prepare high performance carbon fiber, by means of the conventional natural wood pulping process. For this reason, there is not yet a known method of preparing high purity cellulose pulp from wood waste and preparing carbon fiber by using the high purity cellulose pulp as a precursor.

SUMMARY

One or more embodiments of the present invention provide a method of preparing high purity cellulose fiber and high performance carbon fiber by using, not pure unprocessed wood, but wood waste including a great quantity of foreign substances such as an adhesive.

An aspect of the present invention provides a method of preparing carbon fiber including:

pulping, wherein adhesive-impregnated wood waste is treated with an aqueous solution including sodium hydroxide (NaOH) of 25 wt % or higher with reference to the weight of the wood waste, and, thereby, cellulose pulp, wherein hemicellulose, lignin, and the adhesive included in the wood waste are eliminated, is obtained, and wherein a weight ratio of the wood waste to the aqueous solution is 1:4;

bleaching, wherein the cellulose pulp is bleached;

spinning, wherein a spinning dope is obtained by dissolving the bleached cellulose pulp in a solvent and then preparing cellulose fiber by spinning the spinning dope;

stabilizing, wherein a stabilized carbon precursor fiber is obtained by heating the cellulose fiber in an oxidative atmosphere at a temperature range from about 100° C. to about 350° C.; and carbonizing, wherein the carbon fiber is obtained by carbonizing the stabilized carbon precursor fiber in an inert gas atmosphere at a temperature range from about 500° C. to about 1,500° C.

In an embodiment of the present invention, the adhesive may be urea resin-based or urea-melanin resin-based adhesive.

In an embodiment of the present invention, the wood waste may be wood waste including the adhesive of about 20 wt % or less with reference to the weight of the wood waste.

In an embodiment of the present invention, the aqueous solution may include sodium hydroxide of a range from about 25 wt % to about 50 wt % with reference to the weight of the wood waste.

In an embodiment of the present invention, the cellulose pulp obtained in the pulping may include α-cellulose of 90 wt % or more with reference to the weight of the cellulose pulp.

In an embodiment of the present invention, chlorine dioxide may be used as a bleaching agent in the bleaching.

In an embodiment of the present invention, the solvent in the spinning may be selected from the group consisting of a mixed solvent of dimethylacetamide/lithium chloride, a mixed solvent of liquid ammonia/ammonium thiocyanate, and N-methylmorpholine N-oxide hydrate.

In an embodiment of the present invention, spinning in the spinning may be performed by dry-jet wet spinning or wet spinning.

In an embodiment of the present invention, tensile strength of the cellulose fiber may be 0.3 GPa or higher.

In an embodiment of the present invention, tensile strength of the carbon fiber may be 0.5 GPa or higher.

In an embodiment of the present invention, the stabilized carbon precursor may be obtained by treating the cellulose fiber with plasma and heat simultaneously in the stabilizing.

In an embodiment of the present invention, the cellulose fiber added to the stabilizing may include a chemical cross link.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
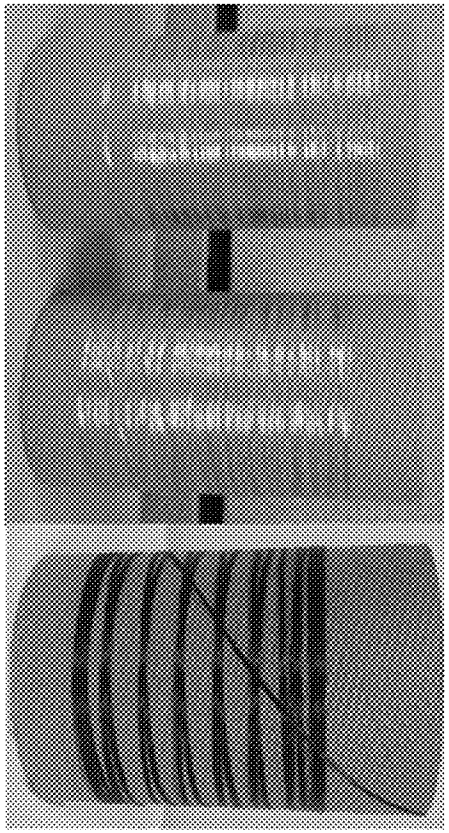
FIG. 1 shows images of cellulose fiber obtained in Example 2 (left) and carbon fiber prepared by using the cellulose fiber as a precursor (right)

Reference will now be made in detail to embodiments, examples of which are illustrated in the accompanying drawings, wherein like reference numerals refer to the like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

Hereinafter, a method of preparing carbon fiber from cellulose fiber obtained from wood waste is described in more detail according embodiments of the present invention.

An aspect of the present invention provides a novel method of recycling wood waste by suggesting a route wherein cellulose is efficiently extracted from wood waste and then the cellulose may be used as cellulose fiber and/or a precursor fiber for making carbon fiber.

Specifically, a method of preparing carbon fiber according to an aspect of the present invention includes:

pulping, wherein adhesive-impregnated wood waste is treated with an aqueous solution including sodium hydroxide (NaOH) of 25 wt % or higher with reference to the weight of the wood waste, and, thereby, cellulose pulp, wherein hemicellulose, lignin, and the adhesive included in the wood waste are eliminated, is obtained, and wherein a weight ratio of the wood waste to the aqueous solution is 1:4;

bleaching, wherein the cellulose pulp is bleached;

spinning, wherein a spinning dope is obtained by dissolving the bleached cellulose pulp in a solvent and then preparing cellulose fiber by spinning the spinning dope;

stabilizing, wherein a stabilized carbon precursor fiber is obtained by heating the cellulose fiber in an oxidative atmosphere at a temperature range from about 100° C. to about 350° C.; and carbonizing, wherein carbon fiber is obtained by carbonizing the stabilized carbon precursor fiber in an inert gas atmosphere at a temperature range from about 500° C. to about 1,500° C.

The wood waste used in the pulping step is wood waste wherein an adhesive is impregnated. Specifically, natural wood generally includes 50 wt % cellulose, 30 wt % hemicellulose, and 20% lignin, although the ratio is dependent on the kind of wood. However, wood waste used in the method of preparing carbon fiber of the present invention additionally includes an adhesive, which is used in processing wood into furniture or other products, at the ratio of 20 wt % or less, typically from about 10 wt % to about 15 wt %. The adhesive representatively includes a formaldehyde-based adhesive such as urea-based resin or urea-melanin-based resin, which is, respectively, urea-formaldehyde resin or urea-melanin-formaldehyde resin in full name. Besides, a phenol resin-based adhesive may be used. The wood waste includes, for example, medium density fiberboard (MDF), particle board (PB), plywood, furniture, wood flooring material, and a mold made of wood. The wood waste may include, for example, Class 2 Wood Waste according to notification of Ministry of Environment of Republic of Korea, or wood waste in unprocessed natural wood type (Class 1 Wood Waste according to notification of Ministry of Environment of Republic of Korea). Shape of wood waste is not specifically limited, but powder type such as sawdust is desirable in order to increase reaction rate. Therefore, plate or bar type wood waste may be pulverized by a method known in the art. According to an aspect of the present invention, high performance carbon fiber may be prepared very economically in comparison to using PAN fiber, rayon fiber, and pitch fiber as a precursor fiber. In particular, single fiber in wood powder and/or wood dust form, which is naturally generated in wood processing procedure, may be used as wood waste. In this case, pulverizing process to enhance wood dissolution in the art may be omitted. However, wood waste may be irradiated by electronic beam before being put into pulping in order to control molecular weight of cellulose obtained from wood waste. A degree of polymerization, i.e., a molecular weight, of the cellulose fiber obtained by electronic beam irradiation may be reduced.

By treating adhesive-impregnated wood waste with an aqueous solution including high concentration sodium hydroxide (NaOH) of 25 wt % or higher with reference to the weight of the wood waste, cellulose pulp, wherein hemicellulose, lignin, and the adhesive included in the wood waste are eliminated, may be obtained. In the pulping step of the present invention, the weight ratio of the wood waste to the aqueous solution is 1:4 as a reference. The aqueous solution may include high concentration sodium hydroxide of about 25 wt % to about 50 wt % of the wood waste.

Generally, in the conventional sodium hydroxide method for obtaining high purity cellulose pulp from wood, with the weight ratio of dried wood material:water:sodium hydroxide=100:382:18 for deciduous tree wood, and the weight ratio of dried wood material:water:sodium hydroxide=100:480:20 for conifer tree wood, sodium hydroxide of about 18 wt % to 20 wt % with reference to dry tree wood raw material is added to eliminate lignin and hemi-cellulose. In comparison, since wood waste includes an adhesive resin and other additives in the present invention, as described above, sodium hydroxide of a higher concentration is added to eliminate hemi-cellulose, lignin, an adhesive, and other additives included in wood waste simultaneously so that high purity cellulose pulp which may be used to prepare cellulose fiber and carbon fiber may be obtained. In the present invention, in order to prepare high purity cellulose wherein impurities except cellulose are eliminated to an extent wherein spinning properties of cellulose fiber in the following spinning step and physical properties of the thus-obtained cellulose fiber and carbon fiber are not negatively affected, wood waste is treated with high concentration sodium hydroxide in combination with bleaching process wherein chlorine dioxide aqueous solution is used as described later. By careful research, the inventors of the present invention discovered that wood waste used in the present invention typically includes a surface adhesive coating and, thus, elimination of impurities including an adhesive as well as delignification simultaneously cannot be appropriately performed by a conventional chemical pulping method. In the present invention, with a fixed weight ratio of wood waste to sodium hydroxide aqueous solution of 1:4, wood waste is treated with an aqueous solution including high concentration sodium hydroxide of 25 wt % or higher with reference to the weight of wood waste. The treatment is generally performed by dipping at a temperature of 20° C. or higher, specifically, 25° C. or higher, for from about one hour to about one week. At that time, stirring at a slow rate may be accompanied. The aqueous solution may include high concentration sodium hydroxide of from about 25 wt % to about 50 wt %, more specifically, from about 30 wt % to about 45 wt %, and more specifically, from about 35 wt % to about 40 wt % with reference to the weight of the wood waste. Sodium hydroxide of such a high concentration shows a sharp contrast to a conventional cellulose pulping method. In a conventional cellulose pulping method, while sodium hydroxide of from about 5 wt % to about 20 wt % with reference to the weight of wood being used, cellulose concentration and a used amount of wood is regulated by controlling the weight ratio of wood to sodium hydroxide aqueous solution to be from about 1:4 to about 1:5. When unprocessed wood is treated with sodium hydroxide of a concentration higher than 20 wt % with reference to the weight of the unprocessed wood, molecular chains of cellulose may be easily broken and thus molecular weights thereof may be decreased. Accordingly, yield of cellulose extracted from wood may be decreased to 40% or lower. However, in the present invention, use of sodium hydroxide of a very high concentration in combination with following bleaching wherein chlorine dioxide is used enables to obtain high purity cellulose pulp from wood waste by delignification and adhesive elimination.

Afterward, chlorine bleaching is performed to eliminate a tiny amount of lignin and adhesive remnant in cellulose pulp which has been purified by using high concentration sodium hydroxide. In the present invention, for a complete elimination of lignin and adhesive remnant, chlorine bleaching is performed by using chlorine dioxide of a high concentration of from about 8 wt % to about 12 wt %, more specifically, from about 9 wt % to about 11 wt %, and more specifically, 10 wt % with reference to the dry weight of the alkali-treated, purified cellulose pulp. The weight ratio of wood waste to chlorine dioxide aqueous solution is 1:5 as a reference. Chlorine bleaching using chlorine dioxide provides advantages such as high bleaching power and low cost in comparison with oxygen bleaching using hydrogen peroxide. When adhesive elimination and delignification are well performed, color of cellulose pulp turns from brown to white by bleaching. Accordingly, cellulose pulp having α-cellulose content of 90% or higher, which may be typically and appropriately used to prepare cellulose fiber filament and carbon fiber filament, may be obtained.

Afterward, a spinning dope is obtained by dissolving the bleached cellulose pulp with a solvent, and then cellulose fiber filament is prepared by spinning the spinning dope.

A spinning process in the spinning step may be performed by a dry-jet wet spinning or a wet spinning. Regardless of spinning methods, a spinning dope is prepared to perform spinning. For this, cellulose pulp is completely dissolved in a solvent. Solvents which may be used for this purpose may include a mixed solvent of dimethylacetamide/lithium chloride, a mixed solvent of liquid ammonia/ammonium thiocyanate, or tertiary amine oxide compounds such as N-methylmorpholine N-oxide hydrate. Among these, use of N-methylmorpholine N-oxide hydrate is desirable as it is capable of directly dissolving cellulose pulp and environmental friendly due to low toxicity. To dissolve the cellulose in the solvent, the cellulose is stirred at a temperature of from about 100° C. to about 120° C. in the solvent, and a spinning dope is prepared as a result. Content of cellulose in the spinning dope is dependent on degree of polymerization of the obtained cellulose, but is determined by considering spinning properties to prepare cellulose fiber filament. Generally, content of cellulose of from about 5 to about 15 wt % is desirable. A spinning dope may include a conventional additive such as an antioxidant, a thermal stabilizer, a ultraviolet stabilizer, a flame retardant agent, a softening agent, a wetting agent, and an anti-static agent at a content generally used in this art.

In the spinning step, a conventional dry-jet wet spinning or wet spinning is performed by using a cellulose spinning dope prepared by directly dissolving cellulose pulp to obtain cellulose fiber filaments, in other words, carbon precursor fiber filaments which may be used as a raw material to prepare carbon fiber. For example, a cellulose spinning dope is spun at an appropriate spinning temperature by putting a cellulose spinning dope to a dry-jet wet spinning instrument having multiple spinning nozzles of from about 0.05 to about 0.3 mm diameter. The thus-obtained cellulose strands are passed through an air layer of from about 1 to about 100 cm, and coagulated in a coagulation bath. After having been removed of remaining solvent in a washing bath, cellulose strands are dried and then bundled and taken up to a bobbin to obtain cellulose fiber filament. Water, acetone, ethyl alcohol, methyl alcohol, and any combination thereof may be used as the coagulation bath. The obtained cellulose fiber filament may show a tensile strength of about 0.3 GPa or higher.

Afterward, carbon fiber filament may be obtained by stabilizing and carbonizing the cellulose fiber filament used as a precursor. Specifically, the cellulose fiber filament is heated in the air or in an oxidative atmosphere such as an atmosphere including an appropriate quantity of oxygen at a temperature of from about 100° C. to about 350° C., typically from about 150° C. to about 300° C., to obtain a stabilized carbon precursor fiber. For example, the stabilizing step may be performed in an electric furnace by heating cellulose fiber filament at a temperature increase rate of from about 1 to about 3° C./min at the maximum temperature of about 260° C. for from about one hour to about three hours, specifically from about 1.5 hours to about 2.5 hours, more specifically for about two hours. During the stabilizing process, chemical changes such as dehydration, oxidation, and pyrolysis occur in cellulose fiber with an decrease of weight, and then cellulose fiber is converted to a type which is appropriate to be applied to the following high temperature carbonizing process.

In the carbonizing process, while heating cellulose fiber filament in an oxidative atmosphere, atmospheric-pressure plasma discharge may be additionally performed to cellulose fiber filament so that reaction rate of the stabilizing may be enhanced and mechanical properties of the obtained carbon fiber may be improved. For example, the plasma discharge may be induced by electrode couple connected with an alternate current (AC) generator, a radiofrequency (RF) generator, or a pulse generator. Surface of an electrode may be formed with an insulator such as quartz or ceramic so that discharge may be stabilized even when applying sufficient electric current. Stabilizing using plasma discharge may be performed in a chamber wherein inlet and outlet size thereof are minimized to minimize contact with the outer atmosphere and heat loss to the atmosphere. The electric power applied to the unit discharge area ($cm^2$) may be from about 100 mW to about 100 W. In addition, frequency of the applied AC power may be 500 Hz or higher.

Atmospheric air wherein its moisture content is controlled; or a gaseous compound or a mixture including at least one of oxygen, nitrogen, hydrogen, and water vapor may be injected into the chamber by means of plasma discharge instrument so that the types and quantities of ionic active species generated by plasma discharge may be controlled. Plasma discharge voltage may be lowered and plasma discharge may be stabilized by additionally injecting to the gaseous compound or the mixture an inert gas including argon, neon, or helium and the like, which makes plasma discharge easier.

On the other hand, chemical crosslinking in cellulose fiber filament may decrease reduction of the weight of the cellulose fiber filament in the stabilizing process as chemical structure of cellulose fiber filament is stable. To form chemical crosslinking in cellulose fiber filament, a silicone polymer solution or aqueous solution of flame resistant salt may be used. Cellulose fiber filament wherein chemical crosslinking is formed may increase carbon fiber yield in the following carbonizing step as drastic pyrolysis is repressed during the carbonizing process.

In the carbonizing, targeted carbon fiber is obtained by carbonizing the stabilized carbon precursor fiber in an inert atmosphere of, for example, nitrogen or argon gas, without oxygen supply, at a temperature of from about 500° C. to about 1,500° C., specifically from about 800° C. to about 1,300° C. For example, the carbonizing may be performed in an electric furnace by heating the stabilized cellulose fiber filament at a temperature increase rate of from about 2 to about 10° C./min, specifically from about 3 to about 5° C./min, more specifically at 4° C./min, at the maximum temperature of about 1,300° C. for from about 0.5 hour to about three hours, specifically from about 1 hours to about 2 hours, more specifically for about 1.5 hours. When the carbonizing temperature is less than about 500° C., un-carbonized decomposition products may be increased. When the carbonizing temperature exceeds about 1,500° C., energy consumption may be increased. When duration of carbonizing is less than about 0.5 hour or more than about 3 hours, carbon content after carbonizing may be low, pore structure and specific surface area may not be developed well. As pyrolysis occurs in the stabilized cellulose fiber during the carbonizing process, carbon fiber wherein content of remnant elements except carbon is less than 1 wt % may be obtained. The obtained carbon fiber may have high performance properties such as tensile strength of about 0.5 GPa or higher, tensile modulus of about 100 GPa or higher, and tensile elongation at break of about 1% or less.

Hereinafter, the embodiments of the present invention are described in detail with reference to Examples, but the embodiments of the present invention are not limited thereto.

Example 1 and Comparative Examples 1 and 2

In Example 1 and Comparative Example 2, cellulose pulp was prepared by using powder type wood waste (Class 2 Wood Waste according to notification of Ministry of Environment of Republic of Korea) generated in MDF and PB manufacturing process, according to the procedures described below. Wood type of the wood waste was pine tree, and the wood waste included an adhesive based on urea-formaldehyde resin or urea melamine formaldehyde resin of from about 12 wt % to about 13 wt %. In Comparative Example 1, natural unprocessed pine tree wood powders were used instead of the wood waste.

As shown in Table 1 below, ratio of sodium hydroxide addition was varied to 10 wt %, 20 wt %, 30 wt %, 40 wt %, 45 wt %, 50 wt %, and 100 wt % with reference to the weight of dried wood waste, and cellulose pulping process was performed by mixing the wood waste, water and sodium hydroxide. The weight ratio of the dried raw material to sodium hydroxide aqueous solution to was fixed at 1:4. For this, the wood waste, water, and sodium hydroxide were put into a 10 L cooking instrument, and cooked at a temperate from about 150° C. to about 160° C. under pressure of about 8 $kg/cm^2$ for about four hours.

After finishing the pulping, a black liquid, which is lignin extraction solution, was separated and removed, and then chlorine bleaching process was performed with the cellulose pulp by using chlorine dioxide ($ClO_2$). For this, dried cellulose pulp obtained in the pulping, water, and chlorine dioxide were put into a 10 L cooking instrument at the weight ratio of 100:490:10 (a weight ratio of chlorine dioxide to dried cellulose pulp of =10 wt %) and bleached at a temperature about 90° C. for about two hours.

Afterward, the bleached cellulose pulp was washed with water of room temperature, and then dried at a temperature about 150° C. Table 2 shows α-cellulose content in the cellulose pulp after pulping, a raw material remnant yield, and color change of cellulose pulp after bleaching, depending on quantity of used sodium hydroxide. α-cellulose refers to cellulose which is not dissolved in 17.5% NaOH aqueous solution at 20° C. In Table 2 below, the raw material remnant yield refers to ratio of remnant raw material weight after the pulping and bleaching processes with reference to 100% raw material weight. For example, when the weight of raw material wood waste is 100 g and the weight of remnant cellulose pulp obtained after pulping was 40 g, the raw material remnant yield is 40%. In this case, when the weight of remnant cellulose pulp after the following bleaching process is 35 g, the raw material remnant yield is 35%. The decreased weight represents the weight of hemi-cellulose, lignin, and ash which are eliminated from wood.

TABLE 1

| Dried wood raw material (g) | | | Water (g) | NaOH (g) |
|---|---|---|---|---|
| Comparative Examples 1 to 2 | 10% NaOH added | 100 | 390 | 10 |
| | 20% NaOH added | 100 | 380 | 20 |
| Example 1 | 30% NaOH added | 100 | 370 | 30 |
| | 35% NaOH added | 100 | 365 | 35 |
| | 40% NaOH added | 100 | 360 | 40 |
| | 45% NaOH added | 100 | 355 | 45 |
| | 50% NaOH added | 100 | 340 | 50 |
| | 100% NaOH added | 100 | 300 | 100 |

TABLE 2

| | | α-cellulose content | Raw material remnant yield after bleaching | Color change after bleaching | Degree of polymerization after bleaching |
|---|---|---|---|---|---|
| Comparative Example 1 (Unprocessed wood used) | 10% NaOH added | 80.7% | 72.1% | light brown | 610 |
| | 20% NaOH added | 91.02% | 47.3% | white | 710 |
| Comparative Example 2 (wood waste used) | 10% NaOH added | 70.82% | 75.6% | dark brown (unchanged) | 500 |
| | 20% NaOH added | 78.95% | 69.4% | dark brown (unchanged) | 580 |
| Example 1 (wood waste used) | 30% NaOH added | 85.94% | 59.4% | light brown | 650 |
| | 35% NaOH added | 90.03% | 50.1% | white | 750 |
| | 40% NaOH added | 92.32% | 45.5% | white | 780 |
| | 45% NaOH added | 92.62% | 40.12% | white | 650 |
| | 50% NaOH added | 92.68% | 34.62% | white | 580 |
| | 100% NaOH added | 93.03% | 26.9% | white | 500 |

According to Table 2, cellulose pulp obtained after pulping process showed dark brown in both cases wherein raw material was unprocessed wood and wood waste. In Comparative Example 1 wherein unprocessed wood was used, after pulping process wherein 20% sodium hydroxide was added and following chlorine bleaching process, lignin was completely eliminated and color of cellulose pulp was turned into white. However, when 10% sodium hydroxide was added, although raw material remnant yield was higher, lignin remnant was higher, and thus color of cellulose pulp was not turned white even after bleaching process. In Comparative Example 1 wherein unprocessed wood was used, when sodium hydroxide of 20% or higher was used, color of cellulose pulp turned into white as cellulose content was increased, but raw material remnant yield was decreased by scission of cellulose molecular chains.

As shown in Comparative Example 2, when sodium hydroxide of 20 wt % or lower is used in pulping process with wood waste as raw material, color of cellulose pulp after bleaching process was dark brown which was almost the same as the color of cellulose pulp after pulping process, and α-cellulose content after bleaching process was 80 wt % or lower. This indicates that when wood waste is used as a raw material, sodium hydroxide of 20 wt % or lower is not sufficient to cause delignification. This may be due to effect of an adhesive included in wood waste raw material.

In Example 1 of the present invention which was another case wherein wood waste was used as a raw material, cellulose pulp color change in bleaching process was found, when sodium hydroxide of 30 wt % or higher was used. When sodium hydroxide of 35 wt % or higher was used, color of cellulose pulp after bleaching process was changed to white, and α-cellulose content after bleaching process was 90 wt % or higher. In addition, the raw material remnant yield was about 50% or lower. When the raw material remnant yield is about 50% or lower, lignin remnant is 1% or lower, and the rest is composed of hemi-cellulose and cellulose. However, sodium hydroxide of 100 wt % was used, cellulose content was similar, but the raw material remnant yield was as low as about 27%, and the result indicated that scission of cellulose molecular chains occurred. Scission of cellulose molecular chains may be also verified by degree of polymerization (DP) measurement value. In this case, degree of polymerization refers to number of repeating glucose residue constituting a cellulose molecular chain. In case of cellulose pulp for textile yarn manufacturing, degree of polymerization of cellulose pulp should be about 600 or higher, or about 700 or higher. However, when cellulose pulp was treated with 100% sodium hydroxide, the degree of polymerization was about 500, which shows that scission of cellulose pulp molecular chains occurred severely and, thus, molecular weight was decreased more than in the case wherein cellulose pulp was treated with 35% sodium hydroxide. Table 2 shows that, when cellulose pulping process was performed by treating wood waste including an adhesive with sodium hydroxide of from about 35 wt % to about 40 wt %, α-cellulose content was 90% or higher and degree of polymerization was about 700 or higher, indicating that cellulose fiber of excellent mechanical properties can be obtained.

Example 2

Figure 2:
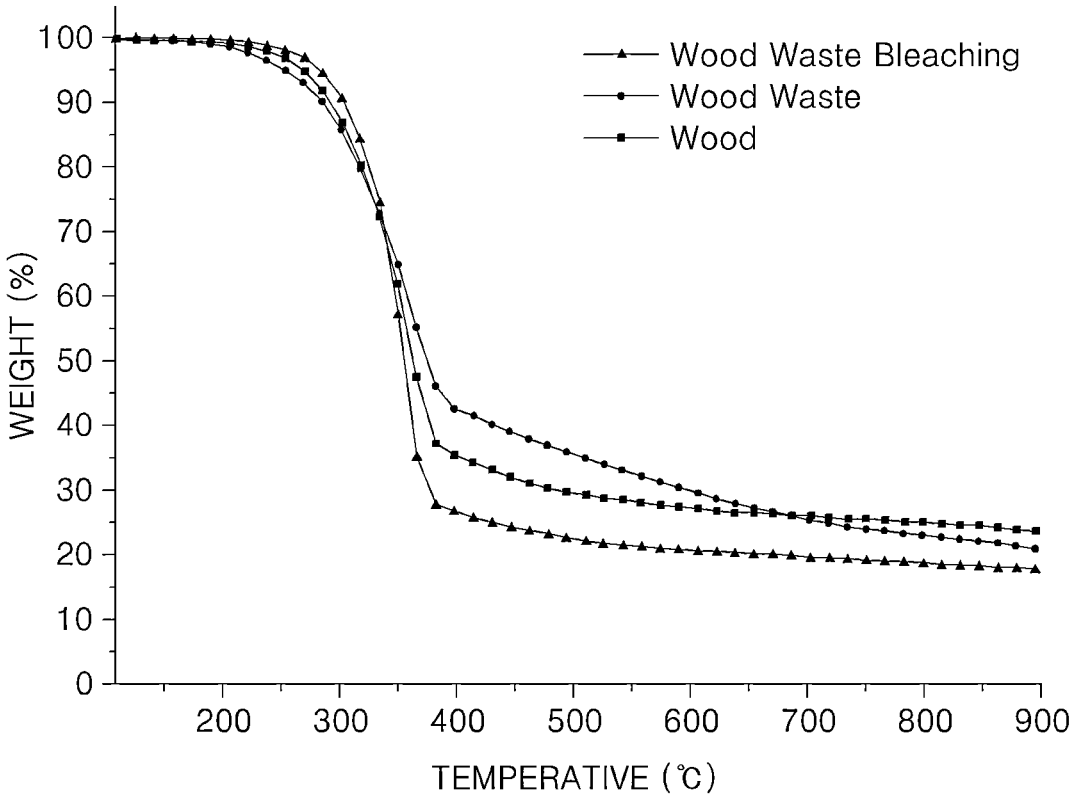
FIG. 2 shows a graph comparing thermogravimetric analysis results of pine tree wood waste including an adhesive (a raw material used in Comparative Example 1 and Example 1, denoted as "wood waste" in FIG. 2), pure unprocessed pine tree wood of the same species (a raw material used in Comparative Example 2, denoted as "wood" in FIG. 2), and cellulose pulp obtained by pulping the pine tree wood waste including an adhesive with 40% sodium hydroxide and then bleaching with 10% chlorine (pulp obtained in Example 1, denoted as "wood waste bleaching" in FIG. 2)
Figure 3:
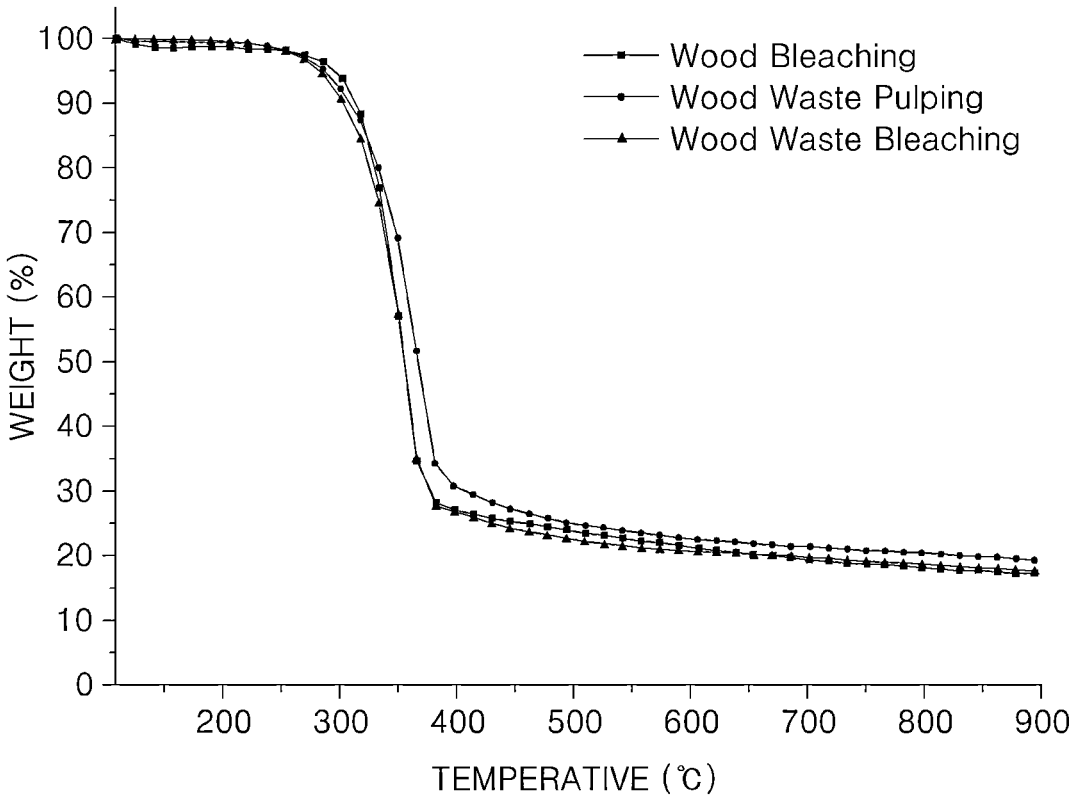
FIG. 3 shows a graph comparing thermogravimetric analysis results of cellulose pulp obtained by pulping the pure unprocessed pine tree wood with 20% sodium hydroxide and then bleaching with 10% chlorine (pulp obtained in Comparative Example 1, denoted as "wood bleaching" in FIG. 3), cellulose pulp obtained by pulping the pine tree wood waste including an adhesive with 40% sodium hydroxide and then bleaching with 10% chlorine (pulp obtained in Example 1, denoted as "wood waste bleaching" in FIG. 3), and cellulose pulp obtained only by pulping the pine tree wood waste including an adhesive with 40% sodium hydroxide (pulp obtained in Example 1, denoted as "wood waste pulping" in FIG. 3).

A thermogravimetric analysis (TGA) was performed to verify whether or not the adhesive impregnated in wood waste had been eliminated after pulping and bleaching in Example 1 and Comparative Example 2, and the results are compared in FIGS. 2 and 3.

FIG. 2 shows a graph comparing TGA results of pine tree wood waste including an adhesive (the raw material used in Comparative Example 1 and Example 1, denoted as "wood waste" in FIG. 2), pure unprocessed pine tree wood of the same species (the raw material used in Comparative Example 2, denoted as "wood" in FIG. 2), and cellulose pulp obtained by pulping the pine tree wood waste including an adhesive with 40% sodium hydroxide and then bleaching with 10% chlorine (pulp obtained in Example 1, denoted as "wood waste bleaching" in FIG. 2).

As shown in FIG. 2, a comparison of TGA results of wood waste and wood indicates that pyrolysis remnant of wood waste was lower than that of wood. In case of pyrolysis of wood waste, pyrolysis remnant might have been lower than that of wood as pyrolysis began at a lower temperature due to existence of an adhesive and impurities such as the adhesive were volatilized. In addition, as TGA graph in FIG. 2 shows, wood waste and wood showed different TGA behaviors. A comparison of the TGA behaviors in FIG. 2 may verify impregnation of an adhesive in raw materials.

A comparison of TGA results of wood and wood waste bleaching indicates that both of wood and wood waste bleaching showed the same TGA behavior while pyrolysis remnant was higher in wood. This might have been due to a fact that an adhesive was eliminated from cellulose pulp in pulping process wherein high concentration sodium hydroxide was used and lignin and hemi-cellulose were also eliminated in bleaching process.

FIG. 3 shows a graph comparing thermogravimetric analysis results of cellulose pulp obtained by pulping the pure unprocessed pine tree wood with 20% sodium hydroxide and then bleaching with 10% chlorine (pulp obtained in Comparative Example 1, denoted as "wood bleaching" in FIG. 3), cellulose pulp obtained by pulping the pine tree wood waste including an adhesive with 40% sodium hydroxide and then bleaching with 10% chlorine (pulp obtained in Example 1, denoted as "wood waste bleaching" in FIG. 3), and cellulose pulp obtained only by pulping the pine tree wood waste including an adhesive with 40% sodium hydroxide (pulp obtained in Example 1, denoted as "wood waste pulping" in FIG. 3).

As shown in FIG. 3, cellulose pulp obtained by treating the pine tree wood with 20% sodium hydroxide and then performing chlorine bleaching (wood bleaching) and cellulose pulp obtained by pulping the pine tree wood waste including an adhesive with 40% sodium hydroxide and then performing chlorine bleaching (wood waste bleaching) showed almost the same TGA behavior, and pyrolysis remnant was also similar as about 17.5%. This indicates that cellulose fiber may be prepared by completely eliminating an adhesive from wood waste by using the method of the present invention.

A comparison of TGA results of cellulose pulp obtained by pulping the pine tree wood waste including an adhesive with 40% sodium hydroxide and then performing chlorine bleaching (wood waste bleaching) and cellulose pulp obtained by treating the pine tree wood waste with 40% sodium hydroxide (wood waste pulping) showed that the former showed a lower pyrolysis remnant than that of the latter as remnant lignin and hemi-cellulose were eliminated by additional bleaching process in the former case.

The results showed that, by using high concentration sodium hydroxide pulping method according to the present invention, pulp having α-cellulose content of 90% or higher can be prepared, even when adhesive impregnated wood waste was used as a raw material instead of unprocessed wood, as delignification and adhesive elimination were performed simultaneously.

Example 3

As in Example 1, bleached cellulose pulp was obtained by pulping the wood waste using 40% sodium hydroxide and bleaching the cellulose pulp using chlorine dioxide of 10 wt % with reference to the weight of the dried cellulose pulp weight. The α-cellulose content of the pulp was about 92% and degree of polymerization of the pulp was about 780.

The cellulose pulp thus obtained was dried and then added to N-methylmorpholine N-oxide monohydrate ($NMMO.H_2O$). A spinning dope was prepared by dissolving the cellulose pulp by heating and stirring the mixture at a temperature of about 105° C. for about two hours. The mixing ratio was $NMMO.H_2O$:the pulp=95:5 to 92:8 (with reference to the weight ratio).

The spinning dope was injected to a dry-jet wet spinning having a spinneret including 100 spinning nozzles of 0.05 mm diameter, and then spun at a spinning temperature of about 90° C. at a discharge rate of 0.2 g/min in an air layer of 2 cm in a coagulation bath including water of 25° C. at a take-up rates of 100 m/min and 150 m/min (drawing ratios of 10 times and 15 times). Cellulose fiber filament was prepared by washing the spun filament, drying in the air of 95° C., and taken up to a bobbin.

Tensile strength, tensile modulus, and tensile elongation at break of the prepared cellulose fiber filament were measured with a universal testing machine. The results are summarized in Table 3.

Example 4

In Example 4, as a precursor fiber, cellulose fiber filament prepared in Example 3 at drawing ratios of 10 times and 15 times was put into stabilizing and carbonizing processes to prepare carbon fiber. In the stabilizing process, the precursor fiber was treated with atmospheric-pressure RF plasma and heat simultaneously in a fiber stabilization instrument. The RF plasma was supplied by providing electric power of 250 W to a 13.56 MHz RF wave source. Stable discharge was induced by coating the power electrode with insulator of 1 mm thickness. Surface damage of the precursor fiber by plasma was suppressed by preventing a direct contact between the precursor fiber and active species generated by plasma discharge by locating a grounded grid electrode at a position about 1 mm from the insulator surface of the power electrode.

The stabilizing process was divided into two stages. In the first stage, plasma was discharged by increasing the temperature inside the fiber stabilization instrument from about 30° C. to about 250° C. by heating the instrument for about 0.5 hour to about 1 hour and by applying electric power of 250 W to an RF wave source. In the second stage, plasma was discharged, while keeping the temperature inside the fiber stabilization instrument at 250° C. or increasing the temperature from 250° C. to 280° C. by heating the instrument for about 0.5 hour to about 1 hour, by applying electric power of 250 W to the RF wave source. During plasma discharging, three kinds of mixed gas, which were 1) Ar 10 lpm(l/m), 2) Ar 10 lpm+$N_2$ 100 sccm, and 3) Ar 10 lpm+$O_2$ 100 sccm, were injected between the power electrode and the grid electrode in order to induce stable discharge and active species generation.

In the following carbonizing process, the stabilized cellulose fiber was carbonized by heating the stabilized cellulose fiber at a rate of 3° C./min up to 1300° C. in nitrogen atmosphere without air supply in an electric furnace. During the temperature increase, the temperature was kept at 800° C. and 1300° C. each for 20 minutes.

Example 5

In Example 5, as a precursor fiber, cellulose fiber filament prepared in Example 3 at drawing ratios of 10 times and 15 times was put into stabilizing and carbonizing processes to prepare carbon fiber. Only heat, without application of plasma, was used in the carbonizing process in this case.

The stabilizing process was performed by heating the precursor fiber in an oxygen atmosphere in an electric furnace. The temperature was increased at a rate of 4° C./min up to 100° C., and then increased at a rate of 1° C./min up to 260° C. When the temperature was increased from 100° C. to 260° C., the temperature was kept at 100° C., 150° C. and 200° C. each for 20 minutes, and then kept at 260° C. for two hours.

In the following carbonizing process, the stabilized cellulose fiber was carbonized by heating the stabilized cellulose fiber at a rate of 3° C./min up to 1300° C. in a nitrogen atmosphere without air supply in an electric furnace. During the temperature increase, the temperature was kept at 800° C. and 1300° C. each for 20 minutes.

Tensile strength, tensile modulus, and tensile elongation at break of the prepared carbon fiber were measured with a universal testing machine. The results are summarized in Table 3 along with the measurement results of the precursor fiber.

The degree of polymerization, raw material remnant yield, tensile strength, tensile modulus, and tensile elongation at break were measured by the methods described below.

<Measurement of Degree of Polymerization>

Degree of polymerization (DP) was measured according to the method described in TAPPIT 230 and KS M ISO 5351. Specifically, viscosity of cupriethylene diamine (CED) solution obtained by dissolving cellulose pulp in CED was measured with CANNON viscometer, thereby obtaining intrinsic viscosity [q] (unit: cPs) was obtained. Molecular weight (M) was calculated by substituting the intrinsic viscosity value to the Mark-Houwink relation below. Degree of polymerization was calculated by dividing the M value with molecular weight of glucose residue.

$$[\eta]=0.0098*M^{0.9}$$

<Measurement of Raw Material Remnant Yield>

Raw material remnant yield was presented as percentage (%) of the weight of cellulose pulp obtained after pulping or bleaching divided by the weight of unprocessed wood or wood waste used as a raw material.

<Measurement of Tensile Strength, Tensile Modulus, and Tensile Elongation at Break>

Tensile strength, tensile modulus, and tensile elongation at break were measured by performing a tensile test with the cellulose precursor fiber and the carbon fiber obtained in the Examples according to ASTM D3822 by using a universal tensile tester (manufactured by Instron Engineering Corp., model name: Universal Testing Machine 5567A) with a 25.4 mm grip gauge at a cross-head rate of 2 mm/min. The measurement values are mean values of ten samples of each fiber.

TABLE 3

| | | Tensile strength (GPa) | Tensile modulus (GPa) | Tensile elongation at break (%) |
|---|---|---|---|---|
| Drawing ratio of 10 times | Cellulose precursor fiber (Example 3) | 0.512 | 25.23 | 4.92 |
| | Carbon fiber (Example 4) | 0.608 | 43.37 | 1.15 |
| | Carbon fiber (Example 5) | 0.748 | 66.54 | 1.13 |
| Drawing ratio of 15 times | Cellulose precursor fiber (Example 3) | 0.845 | 45.52 | 5.32 |
| | Carbon fiber (Example 4) | 0.924 | 67.36 | 1.06 |
| | Carbon fiber (Example 5) | 1.134 | 120.8 | 0.94 |

*Data in Table 3 are mean values of 10 samples.

As shown in Table 3, high strength and high modulus cellulose fiber having tensile strength of about 0.74 GPa and tensile modulus of about 66 GPa, which are comparable to or even higher than those of conventional cellulose fiber, may be prepared even by using wood waste including an adhesive by the preparation method of the present invention. Moreover, high strength and high modulus carbon fiber having tensile strength of about 1.13 GPa and tensile modulus of about 120 GPa, which are the levels enabling commercialization, may be prepared through stabilizing and carbonizing processes by using the cellulose fiber as a precursor fiber.

Notation

"wood waste": pine tree wood waste including an adhesive.

"wood": pure unprocessed pine tree wood of the same species.

"wood waste bleaching": cellulose pulp obtained by pulping the pine tree wood waste including an adhesive with 40% sodium hydroxide and then bleaching with 10% chlorine.

"wood bleaching": cellulose pulp obtained by pulping the pure unprocessed pine tree wood with 20% sodium hydroxide and then bleaching with 10% chlorine "wood waste pulping": cellulose pulp obtained just by pulping the pine tree wood waste including an adhesive with 40% sodium hydroxide As described above, according to the one or more of the above embodiments of the present invention, carbon fiber filament is prepared by extracting cellulose raw material by using wood waste, without using PAN-based fiber or pitch-based fiber which are used as a main raw material of conventional carbon fiber, as a basic raw material, obtaining cellulose fiber by spinning a spinning dope, which is obtained by dissolving the extracted cellulose raw material in an appropriate solvent, and by applying the cellulose fiber as a precursor to stabilizing and carbonizing processes. Therefore, according the method of preparing carbon fiber from recycled wood waste, various technological and economic effect may be obtained as follows:

First, high performance carbon fiber may be obtained while minimizing burden on the environment and human body as wood waste is recycled by using mild chemicals. In addition, social benefit is expected as cost of discarding wood waste is reduced.

Second, high performance carbon fiber may be obtained economically from wood waste, which is much cheaper than PAN-based fiber or pitch fiber used as a precursor of carbon fiber. Wood waste is not only much cheaper than PAN-based fiber or pitch fiber but also easier to secure and supply as a raw material.

Third, carbon dioxide credit may be acquired by reducing timber harvesting by recycling wood waste.

It should be understood that the exemplary embodiments described therein should be considered in a descriptive sense only and not for purposes of limitation. Descriptions of features or aspects within each embodiment should typically be considered as available for other similar features or aspects in other embodiments.

While one or more embodiments of the present invention have been described with reference to the figures, it will be understood by those of ordinary skill in the art that various changes in form and details may be made therein without departing from the spirit and scope of the present invention as defined by the following claims.

What is claimed is:

1. A method of preparing carbon fiber including: pulping adhesive-impregnated wood waste with an aqueous solution including sodium hydroxide of 25 wt % or higher with reference to the weight of the wood waste to remove hemi-cellulose, lignin, and an adhesive included in the wood waste from the adhesive-impregnated wood, thereby obtaining cellulose pulp, wherein a weight ratio of the wood waste to the aqueous solution is 1:4;

bleaching the cellulose pulp;

spinning a spinning dope, which is obtained by dissolving the bleached cellulose pulp in a solvent, to prepare cellulose fiber;

stabilizing the cellulose fiber by heating in an oxidative atmosphere at a temperature range from about 100° C. to about 350° C. to obtain a stabilized carbon precursor fiber; and carbonizing the stabilized carbon precursor fiber in an inert gas atmosphere in a temperature range from about 500° C. to about 1,500° C. to obtain the carbon fiber.

2. The method of claim 1, wherein the adhesive is urea resin-based or urea-melanin resin-based adhesive.

3. The method of claim 1, wherein the wood waste is wood waste including the adhesive of about 20 wt % or less with reference to the weight of the wood waste.

4. The method of claim 1, wherein the aqueous solution includes about 25 wt % to about 50 wt % of sodium hydroxide with reference to the weight of the wood waste.

5. The method of claim 1, wherein the cellulose pulp obtained in the pulping step includes α-cellulose of 90 wt % or more with reference to the weight of the cellulose pulp.

6. The method of claim 1, wherein chlorine dioxide is used as a bleaching agent in the bleaching step.

7. The method of claim 1, wherein the solvent in the spinning step is selected from the group consisting of a mixed solvent of dimethylacetamide and lithium chloride, a mixed solvent of liquid ammonia and ammonium thiocyanate, and N-methylmorpholine N-oxide hydrate.

8. The method of claim 1, wherein in the spinning step, the spinning is performed by a dry-jet wet spinning or a wet spinning.

9. The method of claim 1, wherein the tensile strength of the cellulose fiber is 0.3 GPa or higher.

10. The method of claim 1, wherein the tensile strength of the carbon fiber is 0.5 GPa or higher.

11. The method of claim 1, wherein in the stabilizing step, the stabilized carbon precursor is obtained by treating the cellulose fiber with plasma and heat simultaneously.

12. The method of claim 11, wherein in the stabilizing step, the cellulose fiber includes a chemical cross link.

* * * * *